US005172736A

United States Patent [19]

Sasaki et al.

[11] Patent Number: 5,172,736

[45] Date of Patent: Dec. 22, 1992

[54] APPARATUS FOR MANUFACTURING SPRING UNIT

[75] Inventors: Noboru Sasaki; Tomoaki Nomura; Kazuo Hara; Isamu Yoshino; Toshio Usui, all of Akishima, Japan

[73] Assignee: France Bed Co., Ltd., Tokyo, Japan

[21] Appl. No.: 571,547

[22] PCT Filed: Feb. 26, 1988

[86] PCT No.: PCT/JP88/00209

§ 371 Date: Aug. 24, 1990

§ 102(e) Date: Aug. 24, 1990

[87] PCT Pub. No.: WO89/07994

PCT Pub. Date: Sep. 8, 1989

[30] Foreign Application Priority Data

Aug. 20, 1986 [JP] Japan ..... 61-194905

[51] Int. Cl.[5] ..... B21F 27/16

[52] U.S. Cl. ..... 140/92.7

[58] Field of Search ..... 72/141; 140/92.3, 92.4, 140/92.7, 92.94

[56] References Cited

U.S. PATENT DOCUMENTS

| | | | |
|---|---|---|---|
| 2,062,552 | 12/1936 | Burgess et al. | 72/141 |
| 2,388,106 | 10/1945 | Woller | 140/92.7 |
| 2,742,934 | 4/1956 | Weston | 140/92.94 |
| 3,334,665 | 8/1967 | Black | 140/92.7 |

FOREIGN PATENT DOCUMENTS

| | | | |
|---|---|---|---|
| 45-35653 | 11/1970 | Japan . | |
| 53-35573 | 8/1978 | Japan . | |
| 53-123363 | 10/1978 | Japan . | |
| 55-33897 | 3/1980 | Japan . | |
| 653021 | 5/1951 | United Kingdom | 140/92.3 |

*Primary Examiner*—Lowell A. Larson

*Attorney, Agent, or Firm*—Joseph Scafetta, Jr.

[57] ABSTRACT

An apparatus for manufacturing a spring unit used for mattresses and the like is provided with a first unit for forming coiled springs sequentially out of a single wire and shaping the spring wires by arranging these coiled springs in a lateral row so that side limbs of the coiled springs are adjacent to each other, and a second unit extending across the spring wires and adapted to shape helical wires wound around the side arms of the spring wires so that the helical wires extend across the side limbs. The second unit is provided with a helical wire shaping device which includes a feeding mechanism and another mechanism for forming the straight wire fed from the feeding mechanism into the helical wires and a third mechanism for adjusting a pitch of the helical wires. The second unit is also provided with a device for supplying the helical wires while measuring and controlling the length of the helical wires in such a manner that this length substantially agrees with the width of the spring wires. Also, an end former is disposed so that it can be positioned freely in the widthwise direction of the spring wires. The end former is adapted to cut the end portion of the helical wire.

1 Claim, 11 Drawing Sheets

APPARATUS FOR MANUFACTURING SPRING UNIT

BACKGROUND OF THE INVENTION

1. Field of the Invention

This invention relates to an apparatus for manufacturing a spring unit used for mattresses and the like.

2. Description of the Related Art

Japanese Utility Model Publication No. 35,573/78 discloses an apparatus for manufacturing a spring unit, in which a plurality of coil springs ar formed by bending a resilient wire. These coil springs form a spring band having a predetermined thickness, such that coil springs are arranged side by side in a row and their side limbs are adjacent to one another. The spring units further comprise helical wires which interconnect the side limbs of the spring band. These helical wires are wound around the side limbs by moving the helical wires in the axial direction thereof while the helical wires are rotated in a manner of a screw in a direction transverse to the spring band. After the helical wires are wound to the spring band, the ends of the helical wires are cut off and then bent by a tool, in the end treatment.

Where the spring bands are used for mattresses, the width of the spring bands varies, depending on the sizes of the mattress, that is, whether the mattress is used for a double size, semi-double size or single size bed. Therefore, it is necessary to vary the feeding length of the helical wires in accordance with the width of the spring bands. However, in the prior apparatuses for manufacturing spring units, the feeding length of the helical wire is not automatically controlled in accordance with the width of the spring bands.

Further, the opposite ends of the helical wires wound around the spring bands are cut off and bent by the tool, in the end treatment. The tool is, however, provided in a fixed position in relation to the width direction of the spring bands. Therefore, when the width of the spring bands is changed from that for the double size to that for the semi-double or single size, the position of the tool is deviated from the lateral borders of the spring bands in the width direction thereof, so that the ends of the helical wires are no longer treated by the tool.

Further, the prior art apparatus for making the spring unit, as disclosed in the publication, is not provided with any means for forming straight wires into helical form and automatically feeding these helical wires to the side limbs of the spring bands. Therefore, it is necessary to perform, as independent steps, a step of forming helical wires and a step of combining these helical wires with the spring bands, thus causing the productivity of workers making the spring units to be reduced.

SUMMARY OF THE INVENTION

A first object of the invention is to provide an apparatus for manufacturing a spring unit, which apparatus controls the feeding length of helical wires in accordance with the width of spring bands and allows end treatment of the helical wires to be performed, even if the width of the spring bands is changed.

A second object of the invention is to provide an apparatus for manufacturing the spring unit, which apparatus can automatically and continuously perform a step of forming straight wires into a helical form and a step of winding the helical wires around the side limbs of the spring bands.

To attain the first object of the invention, there is provided an apparatus for manufacturing the spring unit, which apparatus comprises a feeding device for feeding helical wire while the feeding device controls a feeding length of helical wire so as to be substantially equal to the width of the spring band and an end treatment device provided such that its position is adjustable in the width direction of the spring bands, for cutting off and bending the forward end of the helical wire in the feed direction thereof at a position where one of the lateral borders of the spring bands is located.

With the feeding device and the end treatment device, it is possible to control the feeding length of the helical wire in accordance with the width of the spring band, to cut off and then to bend the forward end of the helical wire in the feeding direction. Consequently, even if the width of the spring bands is changed to that for the double size, semi-double size or single size, it is possible to correspondingly feed a proper length of helical wire and also reliably treat the forward end of the helical wire.

To attain the second object of the invention, there is provided an apparatus for manufacturing the spring unit, which apparatus comprises a forming device including a feeding mechanism for feeding straight wire prior to a step of interconnecting the side limbs of the spring bands with helical wire, a forming mechanism for forming the straight wire fed from the feeding mechanism into a helical form and an adjustment mechanism for adjusting the pitch of the helix formed in the forming mechanism.

Where such a forming unit is provided in the apparatus for manufacturing the spring unit, the step of forming helical wire and the step of combining the helical wire with the spring bands can be performed continuously and automatically, thus permitting the improvement of productivity. The pitch of the helical wire can also be adjusted by the adjustment mechanism, so that it is possible to eliminate the dispersion of the pitch due to the material of the wire and permit reliable interconnection of the side limbs of the spring band.

DETAILED DESCRIPTION OF THE PREFERRED EMBODIMENT

Figure 1:
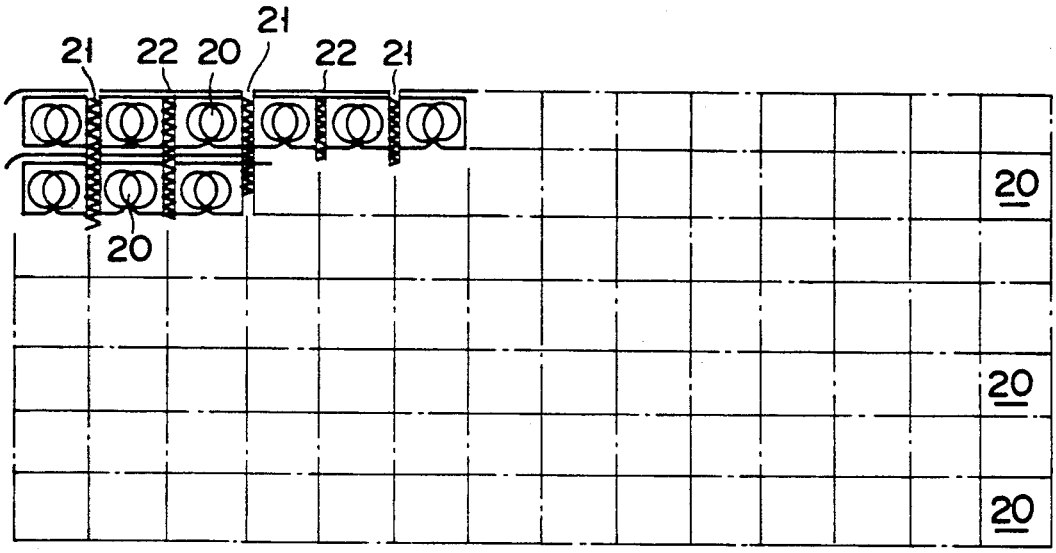
FIG. 1 is a plan view showing a spring unit according to the present invention.
Figure 2:
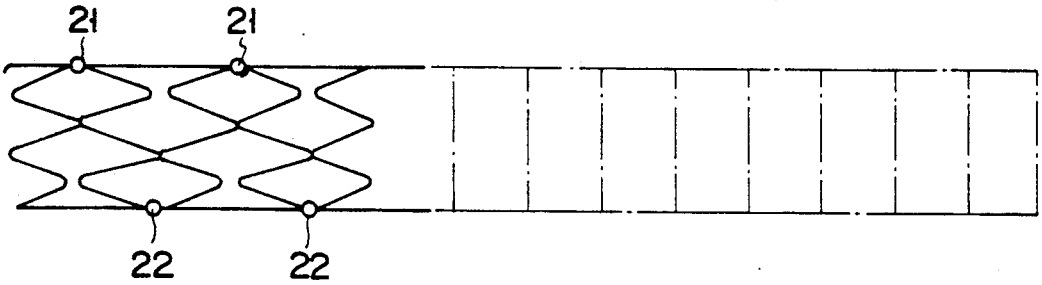
FIG. 2 is a side view showing the spring unit shown in FIG. 1.
Figure 3:
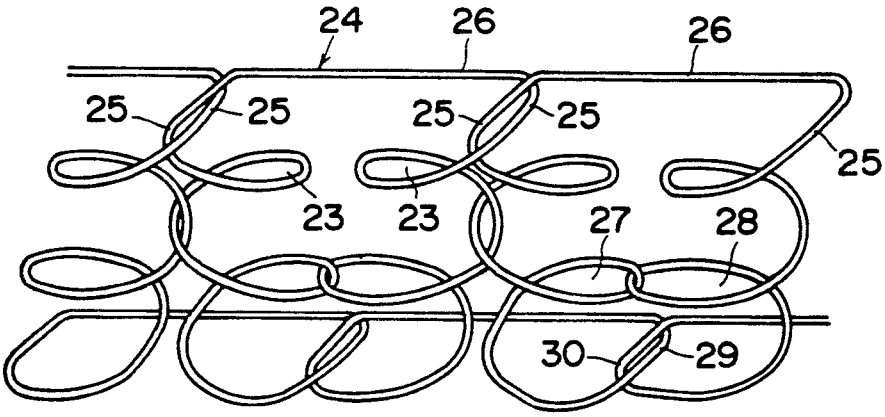
FIG. 3 is a perspective view showing one of the spring elements constituting the spring unit shown in FIGS. 1 and 2.

FIGS. 1 and 2 schematically illustrate a spring unit manufactured by the apparatus according to the present invention. This spring unit is intended for use in a spring mattress, but similar units may well be used for other upholstery, cushions, motor vehicle seats and the like. The illustrated spring unit comprises a plurality of bands of springs. Each band 20 has a shape as shown in FIG. 3, as will be described later in detail. Bands 20 are arranged side by side in rows and are interconnected by helical wires 21 and 22 extending transversely of the bands 20. As shown in FIG. 2, two sets of helical wires 21 and 22 are used. One set of the helical wires 21 is used for the upper face of the spring unit. The other set of the helical wires 22 is used for the lower face of the spring unit. The helical wires 21 and 22 in these two sets are provided at the top and bottom of the spring unit respectively and are staggered relative to one another so that they occur alternately.

Each band 20 comprises a length of resilient wire bent so as to form a plurality of coils or coil springs 23, as shown in FIG. 3, arranged side by side in a row. The coil springs 23 are generally helical in shape and successive coil springs 23 are alternately left- and right-handed. Each coil spring 23 is joined at one end to the adjacent coil spring 23 to one side of it and at the other end to the adjacent coil spring 23 to the other side of it. Each pair of adjacent coil springs 23 is interconnected by loop 24 which consists of part of the length of wire constituting the pair of coil springs 23. Loop 24 is shaped approximately as three sides of a rectangle or as the letter U, having two generally parallel side limbs 25 and a connector 26 between side limbs 25. Loop 24 is substantially flat and lies in the plane of one edge face of the band 20. Side limbs 25 extend in a direction transverse to the length of the band 20. Connector 26 extends lengthwise of the band 20. The length of connector 26 is such that side limbs 25 to which it is joined are so spaced that two coil springs 23 to which they are joined stand between side limbs 25. Loops 24 are successively arranged along the opposite edge faces of band 20 so that there are two groups of loops 24. More specifically, one group of loops 24 is arranged along one edge face of band 20. The other group of loops 24 is arranged along the other edge face of band 20. There is little or no gap between successive loops 24 in each group. Therefore, considering any pair of successive loops in either group coil springs 27 and 28 are isolated. It will be understood that one side limb 29 of one coil spring 27 is located close to and parallel with one side limb 30 of the other coil spring 28.

As shown in FIG. 1, helical wires 21 and 22 embrace a pair of adjacent side limbs 25 of each band 20, i.e., a pair of adjacent side limbs 25 is embraced by one helical wire 21 or 22.

Figure 10:
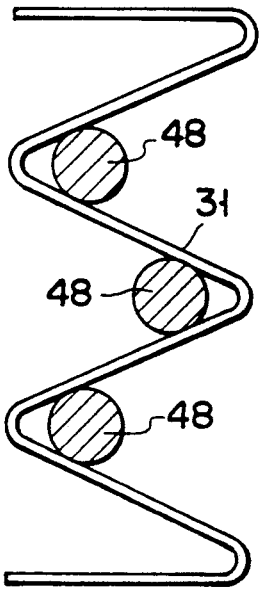
FIG. 10 is an end view showing a spring band shown in FIG. 3 along with a modified guide.

Each coil spring 23 in each band 20 is coupled to the two coil springs 23 on either side of it such that each coil spring has some of its turns linked to turns of the two adjacent coil springs 23. This relation of coupling is shown in FIG. 3 (although it is not shown in FIG. 1 for the sake of simplicity of the drawings). In an end view, each band 20 presents a sinuous appearance; and at no point between one edge and the other edge has band 20 a thickness much greater than the thickness of the wire from which the band 20 is formed. FIG. 10 shows an end view of one band 31. The band 31 having this shape can therefore be wound into a drum-shaped coil so that the drum-shaped coil is substantially parallel with the longitudinal axes of the bands 31 and turns of the drum-shaped coil intersect turns of the adjacent coil.

FIGS. 4 to 8 show an apparatus which is intended for use in manufacturing a spring unit using a plurality of bands 20 which comprise the coils wound in such a shape.

Figure 4:
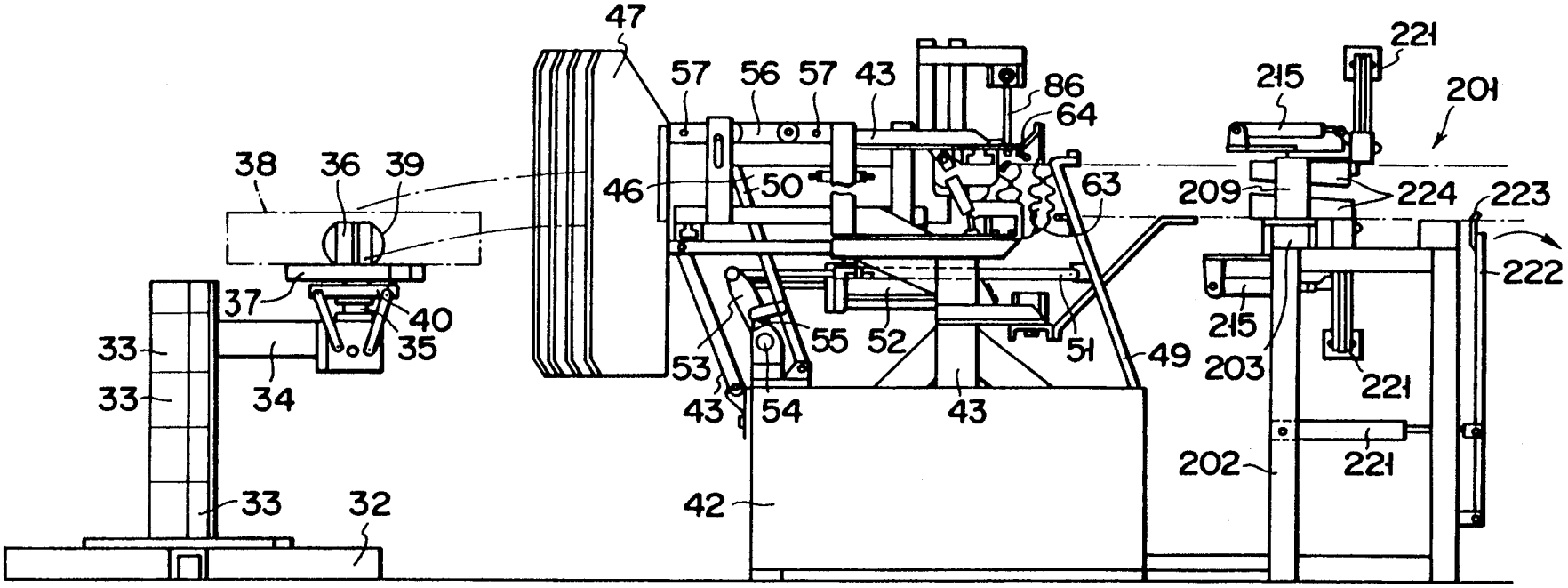
FIG. 4 is a side view showing an apparatus for manufacturing spring units according to the present invention.

Bands 20 wound into a ring form are laid on suitable supports (only a single support being shown in FIG. 4). The support is provided with base 32. Base 32 has an upright pillar-like member. A plurality of sleeves 33 is mounted on the pillar-like member. Each sleeve 33 has an arm 34 extending transversely. Only a single sleeve 33 with the arm 34 is shown in FIG. 4 for the sake of simplicity of the drawings. Upright spindle 35 is mounted on the free end of each arm 34. Spindle 35 supports a rotor. The rotor comprises a pipe-like member 36 rotatable about spindle 35 and a circular plate 37 mounted under the pipe-like member 36. Spring band 38 rests on the circular plate 37. Fin 39 is provided on an upper end portion of pipe-like member 36. Fin 39 engages with a central portion of the spring band 38. The rotor thus rotates with the spring band 38. Adjustable friction pad 40 is provided to hold a lower end portion of the pipe-like member 36 to prevent the spring band 38 from unwinding in an uncontrolled manner. It will be understood that this apparatus of manufacture permits a desired number of spring bands 38 to be mounted for assembly to obtain a complete spring unit.

A main portion of the apparatus according to the present invention is shown in FIG. 4. The main portion includes support 42. Frame 43 is secured to support 42. Frame 43 is provided with a plurality of guide grooves 44 (FIG. 5) arranged transversely in a row. Frame 43 includes a flat bottom plate 45 (FIG. 5) having upright plates 46. Upright plates 46 are parallel to and spaced apart from one another. Guide passages are defined between adjacent upright plates 46. Each guide grove 44 has an outwardly open rear end 47. Upright plates 46 (FIG. 4) extend vertically so that the spring band 38 can be readily guided from the support 42 into the apparatus.

Although not shown in detail, in a modification of the apparatus, a plurality of bars are provided in lieu of guide grooves 44. Each spring band 38 is guided by three or more parallel bars which are spaced apart from one another. In this modification, bars are positioned on opposite sides of the spring band 38 and are arranged in grooves which are defined by the curved spring band 38 and which extend in the longitudinal direction. This arrangement is apparent when the spring band 38 is viewed from its one end. A typical arrangement of bars, in which three bars 48 are used, is shown in FIG. 10.

Figure 5:
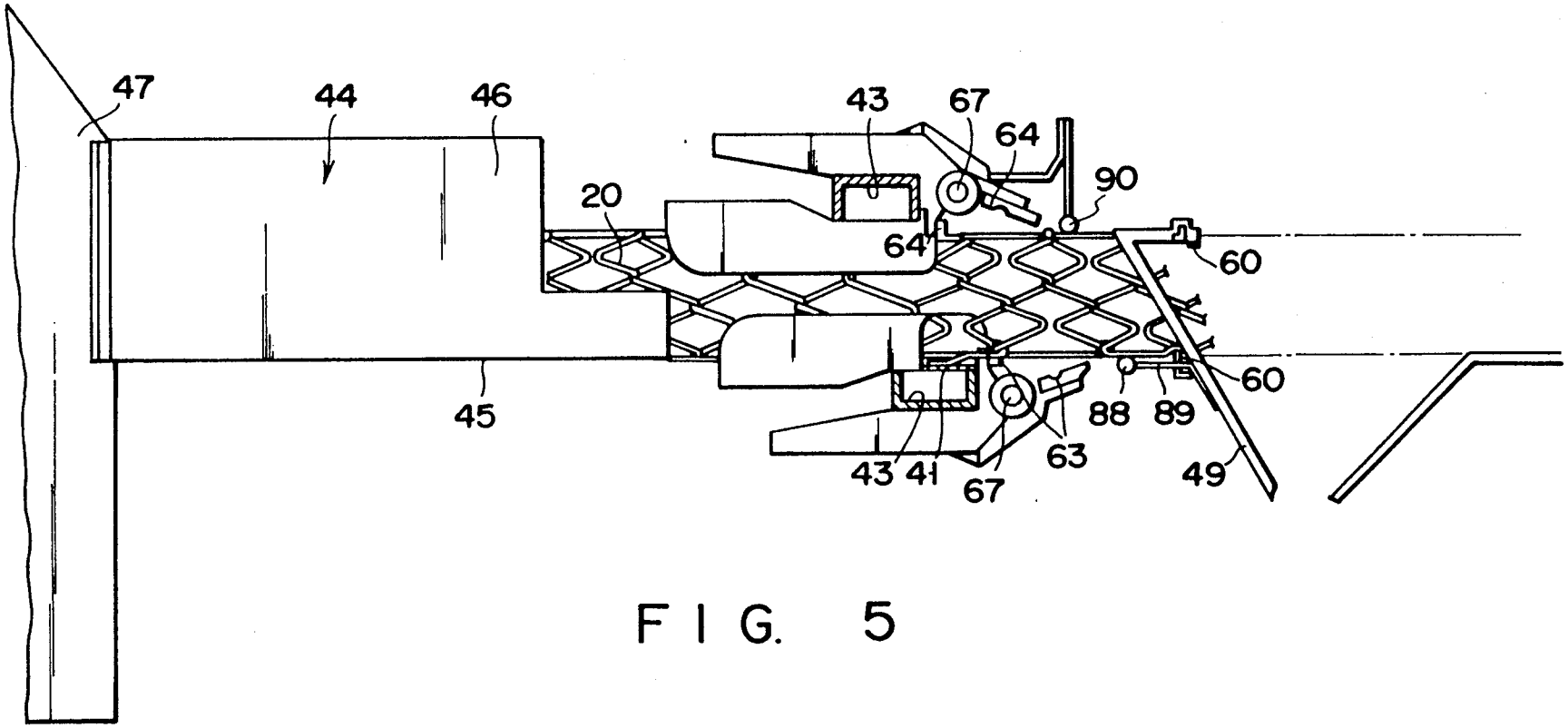
FIG. 5 is a fragmentary view, to an enlarged scale, showing a portion of the apparatus shown in FIG. 4, other than a removed portion.
Figure 7:
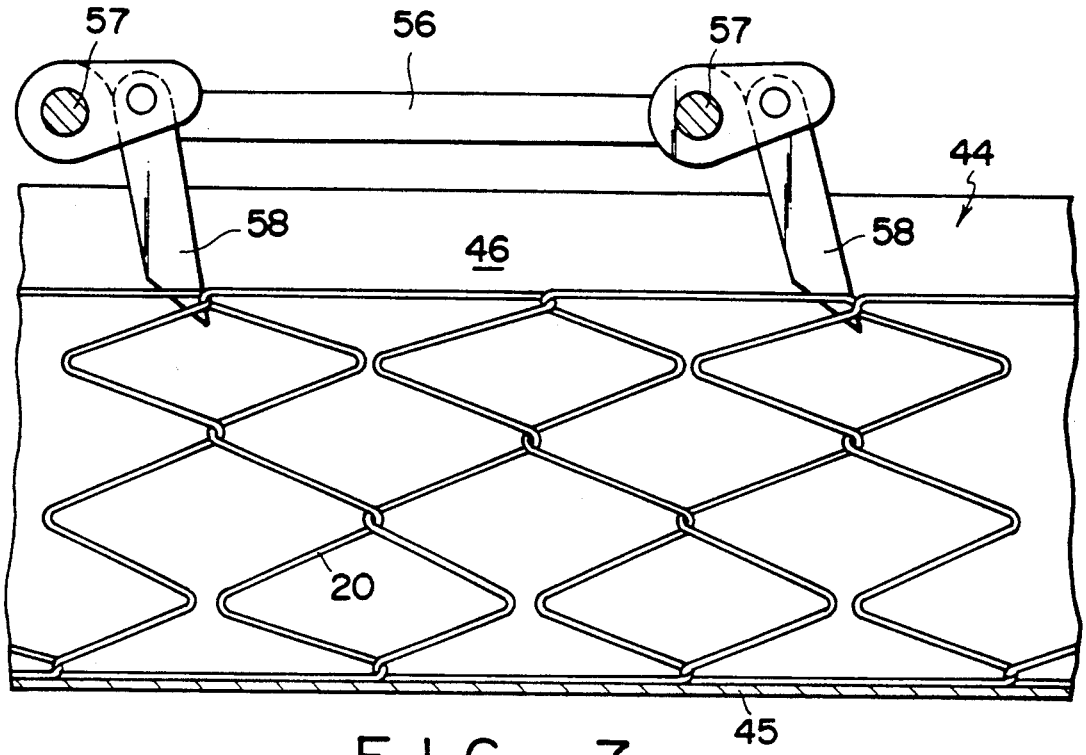
FIG. 7 is a sectional view, to an enlarged scale, showing a portion of the apparatus shown in FIG. 4.

In FIG. 5, end portions of guide grooves 44 remote from the band reception end thereof, extend straight, horizontal and parallel and lead to a linking station which will be described later in detail. Feeding means ar provided and serve to engage some of the spring bands 20 and to push them bodily forward, in each cycle of the operation of the apparatus. The feeding means include four parallel links 49 and 50, two provided on each side of the apparatus. These links 49 and 59 (FIG. 4) are rotatably supported at their lower end by the support 42 and are coupled, at a point above their lower end, to a pair of adjustable connecting links 51. Connecting links 51 can be reciprocally moved by a piston-and-cylinder assembly 52 operable by compressed air. Assembly 52 is mounted on the stationary frame 43 and is coupled to an arm 53 mounted on a shaft 54. Shaft 54 supports arms 55 at its opposite end portions. These arms 55 are coupled to the pair of links 50 positioned at their rear side. Transporter 56 of a wheel type can run along the stationary frame 43. As shown in FIG. 7, the transporter 56 has a pair of parallel bars 57 extending across the open tops of the guide grooves 44. As shown in FIG. 4, the transporter 56 is coupled to and is reciprocally moved by a pair of links 50 which are arranged at its rear side. Bars 57 each support a plurality of fingers 58 (FIG. 7). These fingers 58 are hung from the bars 57 into the guide grooves 44. As shown in FIG. 7, each finger 58 can swing forwards but cannot swing backwards. In each operational cycle of the piston-and-cylinder assembly 52 (FIG. 4), fingers 58 (FIG. 7) engage the spring bands 20 and push them forwards by a distance corresponding to the width of two coils and then return and can engage the spring bands 20 again at a position thereof spaced apart a distance corresponding to the width of two coils from the position a which fingers 58 have engaged the spring bands 20 (FIG. 7).

Figure 6:
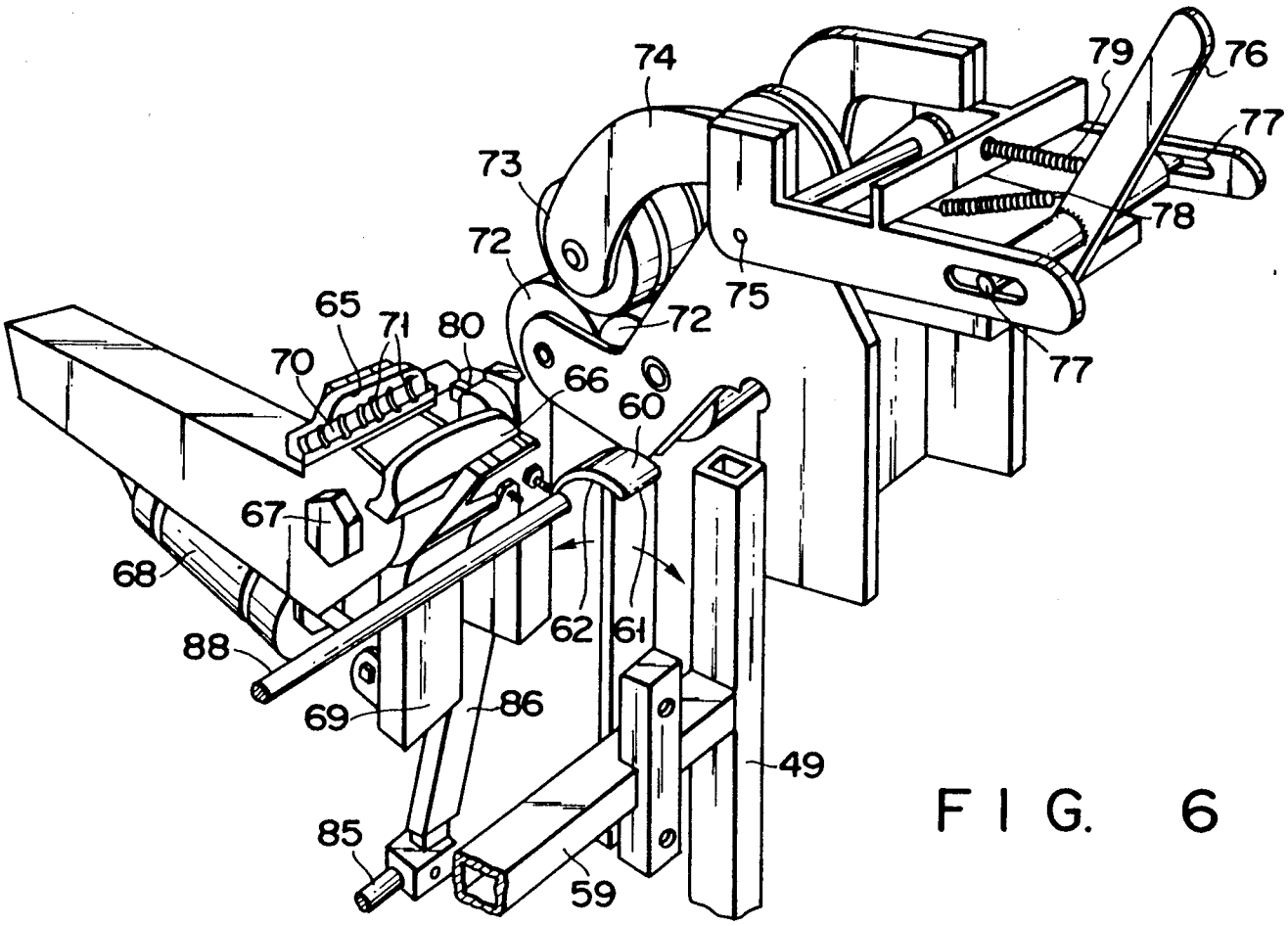
FIG. 6 is a perspective view showing a portion of the apparatus shown in FIG. 4, other than a removed portion.

Transversal bar 59 (FIG. 6) extends between the pair of links 49 arranged at a forward side and carries a plurality of pawls 60. Of these pawls 60, each pair is associated with each spring band 20. One of the pair of pawls 60 is positioned upwardly of the spring band 20 and the other is positioned downwardly of the spring band 20. Pawls 60 have an identical shape, as typically shown in FIG. 6. As shown in FIG. 6, the pawl 60 has a front side portion 61, which can engage one spring band 20 and pull the spring band 20 forwards as the pawl 60 itself is moved forwards, and a rear side portion 62, which is inclined as the rear side portion 62 goes away from the associated spring band 20. Thus, as the pawl 60 is moved backwards, it is disengaged from the associated spring band 20. As shown in FIG. 7, the fingers 58 are arranged so as to push the spring bands 20 forwards by a distance corresponding to the width of two coils in one cycle of the operation of the apparatus. At the linking station shown in FIG. 5, there are two sets of jaws 63 and 64 which constitute grasping means. One set of jaws 63 is arranged below the spring bands 20 and the other set of jaws 64 is arranged above the spring bands 20. Lower and upper jaws 63 and 64 are vertically spaced apart by a distance substantially corresponding to the thickness of coil springs 23 and also are spaced apart horizontally by a distance substantially corresponding to the diameter of the coil springs 23. Each set of jaws 63 and 64 comprises pairs of jaws corresponding in number to the number of spring bands 20. Each pair of jaws 63 and 64 act on the associated spring band 20. One jaw 65 of each pair is stationary and extends in a generally vertical direction, as shown in detail in FIG. 6. The other jaw 66 is pivotably connected to the fixed jaw 65, in a considerably large angle range, by horizontal pivotal pin 67 which extends transverse to the direction of feeding of the spring bands 20. Although only one lower jaw set 63 is shown in FIG. 6, the remaining lower jaw set 63 is the same as the illustrated one. The upper jaw sets 64 are also like the lower ones except that they are inverted. Each jaw pair 63 and 64 is controlled for operation by associated piston-and-cylinder assembly 68 operable by compressed air. The cylinder of the assembly 68 is pivotally connected to the frame 43 and its piston is coupled so that extension 69 of jaw 66 extending beyond pivotal pin 67 is pivotable. Inclined plate 41 (FIG. 5) is mounted on the rear end of the stationary jaw 65 (FIG. 6) of each lower jaw set 63 so that the edges of the spring band 20 can move on the jaws 63 without the edges of the spring band 20 being caught by the jaws 63 (FIG. 5).

When the pairs of jaws in the lower and upper jaw sets 63 and 64 are opened, the feeding means are operated to feed the spring bands 20 forward as described above. When the forward movement of the spring bands 20 is completed, the pairs of side limbs 25 of the loops 24 have passed over the backs of the stationary jaws 65 (FIG. 6) and then snapped into the open mouths of the jaws 63 and 64 (FIG. 5). While some pairs of side limbs 25 are urged against the inner faces of the adjacent stationary jaws 65 (FIG. 6), almost all side limbs 25 move a short distance beyond the stationary jaws 65 but remain in the open mouths of the jaws 63 and 64 (FIG. 5). Next, movable jaws 66 (FIG. 6) are then pivoted backwards against the feeding direction of the spring bands 20 toward stationary jaws 65. Movable jaws 66 carry the pairs of side limbs 25 backwards to stationary jaws 65 and accurately position the side limbs 25. The distance covered by side limbs 25 is so small that the spring bands 20 (FIG. 5) are not moved bodily but are only flexed somewhat by the movement of the side limbs 25.

Figure 9A:
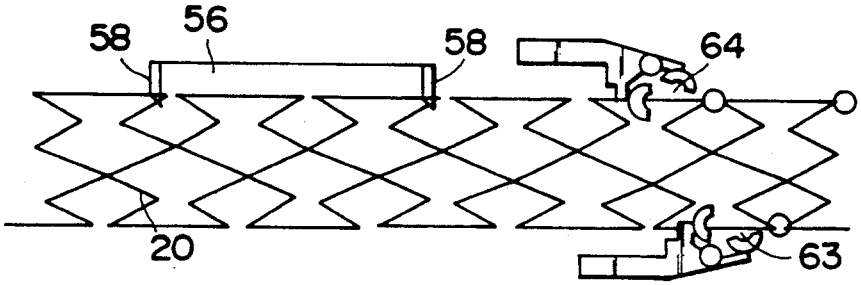
FIGS. 9*a* to 9*c* are fragmentary side views showing three sequential steps in the process of manufacturing a spring unit with the apparatus shown in FIG. 4.
Figure 9B:
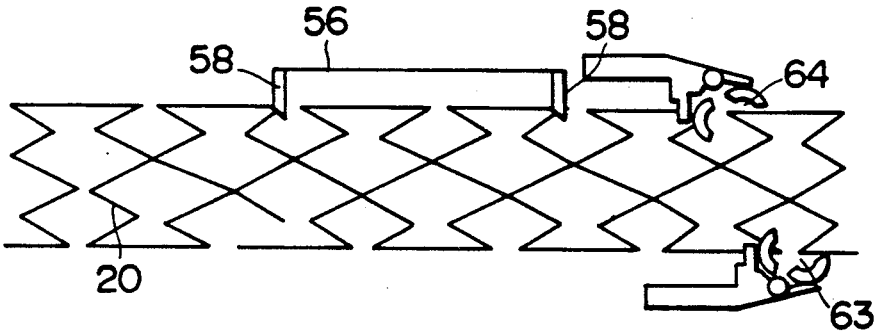
Figure 9C:
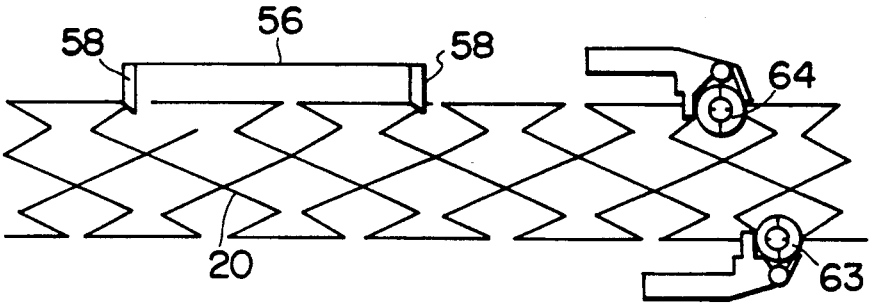

In FIG. 6, the jaw 66 which has pivoted is shown at its intermediate position between its perfectly open position and its perfectly closed position. The cycle of operations described above is illustrated in FIGS. **9*a*, 9*b*, and 9*c*. FIG. 9*a* shows a state in which the jaws 63 and 64 are open and the spring bands 20 have been moved forward by the fingers 58. FIG. 9*b* shows a state in which the fingers 58 are in the foremost positions and the pairs of side limbs 25 of the spring band 20 are in the jaws 63 and 64. FIG. 9*c* shows a state in which the jaws 63 and 64 are closed and side limbs 25 of the spring band 20 are pulled slightly rearwardly, and also a state, in which the fingers 58 are returned to the rear-most positions to be ready for pushing the spring bands 20 forward if the jaws 63 and 64** are opened.

Recess 70 in FIG. 6 is defined in the inner faces of each pair of jaws 65 and 66, that is, the faces which meet when the jaws 65 and 66 are closed. Recess 70 forms a tubular opening having two open ends for receiving a pair of side limbs 25 of the spring band 20 in FIG. 5. Further in FIG. 6, the wall defining the tubular opening has some grooves 71. These grooves 71 serve to define a continuous helix when the jaws 65 and 66 are closed. A slight gap remains between the jaws 65 and 66 of each pair so that a portion of helical wire 21 successively linked to side limbs 25 of the spring band 20 can be received into the gap. Such helical groove 71 receives one helical wire 21 for connecting the side limbs 25 of one pair as shown in FIGS. 1 and 2 and hence links together adjacent spring bands 20. Helical wire 21 is introduced, in a manner of a screw, into the helical groove 71 from one end of the jaws 65 and 66 of each pair immediately after the jaws 65 and 66 are closed. Each of the two helical wires 21 is rotated and moved axially by the mechanism shown in FIG. 6. This mechanism is mounted on the stationary frame 43 such that the mechanism faces the device shown in FIG. 4. The mechanism shown in FIG. 6 comprises a pair of parallel rollers 72 having respective annular grooves. Rollers 72 can be rotated continuously in the same direction by a motor (not shown). Third roller 73 also having annular grooves is mounted in support means 74 which is pivotally coupled to frame 43 (FIG. 4) at a position 75 (FIG. 6). Manual lever 76, which is pivotally connected to the frame 43 (FIG. 4) at the lower end portion thereof, supports arms 77 (FIG. 6). These arms 77 center the manual lever 76 in a slot provided as shown in FIG. 6. Lever 76 is urged to the illustrated position by a coil spring 78 and is controlled by an adjustable stopper 79. The manual lever 76 is pulled downwards by the operator of the apparatus and is released after inserting one end of one helical wire 21 between rollers 72 and 73. As a consequence, the helical wire 21 is pulled in the lengthwise direction while it is rotated, in the condition that the helical wire 21 is held between the rollers 72 and 73. The distance covered by the helical wire 21 is restricted by a stopper which is secured to the apparatus on the side opposite to the feeding mechanism described above.

Figure 8:
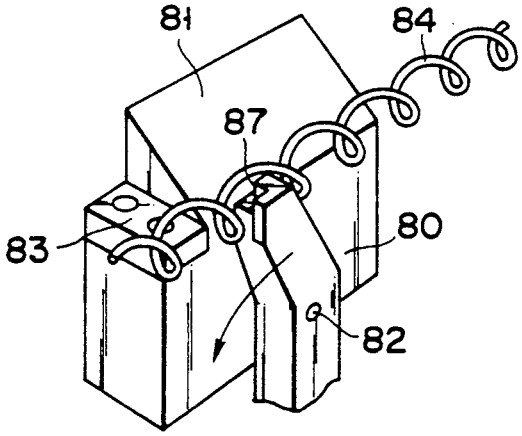
FIG. 8 is a perspective view showing a portion of the mechanism shown in FIG. 6, other than a removed portion.
Figure 11:
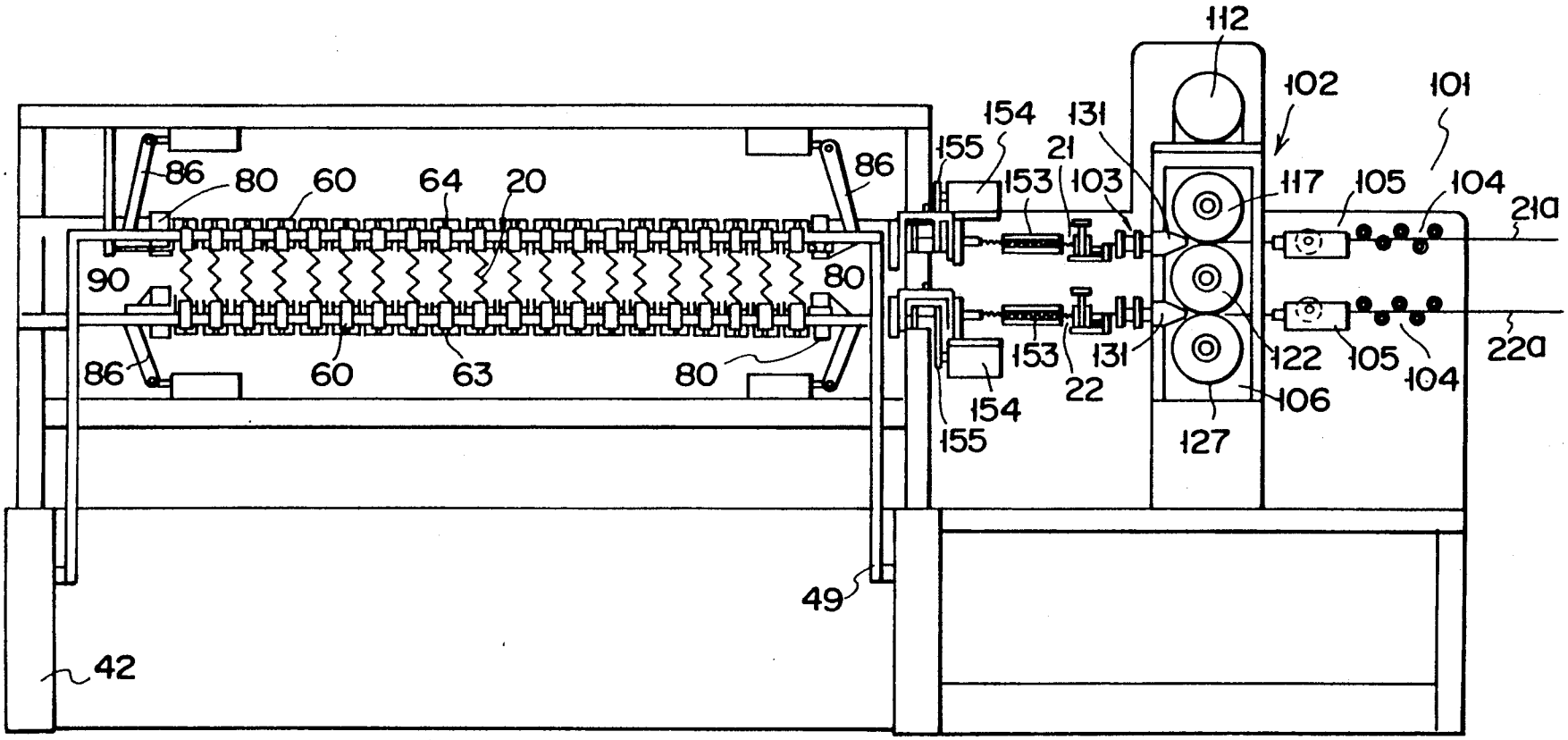
FIG. 11 is an elevational view showing the entire apparatus shown in FIG. 4.

After two helical wires 21 have been linked to the spring bands 20, the end portions of the spring bands 20, which project a short way beyond the sets of jaws 65 and 66, are cut off. The newly formed ends of the helical wires 21, close to the jaws 65 and 66 which are positioned at the end side, are bent inwards. The newly formed ends are thus wound around the adjacent portion of the spring band 20 which is positioned at the end side. As a result, the loop 24 is formed. This cutting and bending of the end of each helical wire 21 is performed by a fixed tool 80 (FIGS. 6, 8 and 11). Tool 80 constitutes a first end treatment device which is pivotably connected to a stationary member 81 (FIG. 8) at the adjacent end of the jaw pair by a flat pivot pin 82 extending parallel with the feeding direction of the spring bands 20. The first end treatment device, as shown in FIG. 11, comprises a plurality of pairs of tools 80, each pair being vertically spaced apart from one another by the same distance as the thickness of the spring bands 20. The pairs of tool 80 also are spaced apart a predetermined distance in the feeding direction of the helical wire 21. More specifically, the vertical set of rearward tools 80 which are positioned at the inlet for the helical wire 21 in the feeding direction and the pair of forward tools 80 at a forward position are spaced apart from one another by a distance substantially equal to the width of a double-sized bed using the spring bands 20.

In FIG. 6, the fixed tool 80 is shown separated from the adjacent jaw 65. Stationary cutter block 83 shown in FIG. 8 is bonded to the stationary member 81. Helical wire 84 is also shown in FIG. 8. In use, the fixed tool 80 is pivoted in the direction of an arrow in FIG. 8 by a piston-and-cylinder assembly operable by compressed air, piston 85 of which (FIG. 6) is coupled to extension 86 of the tool 80 beyond the flat pivot pin 82 (FIG. 8) Upright lug 87 urges the helical wire 84 against the cutter block 83 to cut off the end of the helical wire 84 and bend the cut end towards the adjacent band until the cut end forms a closed or substantially closed loop.

After the cutting and bending, the tools 80 are returned to their initial positions, the jaws 65 and 66 (FIG. 6) are opened to release the helical wires 84 (FIG. 8), and the feeding means are again operated to move the bands 20 (FIG. 5) and any completed part of the spring unit forward. Links 49 are pivoted about their lower ends, so that pawls 60 are raised as they pull the linked bands 20 forward, thereby also raising the bands 20. Thus, the bands 20 are made to be readily separable from the lower sets of the jaws 63. The lower of the bands 20 from the jaws 63 is assisted by transverse bars 88 which are disposed below the bands 20 and are secured to the links 49 through brackets 89. The upward movement of the bands 20 tends to obstruct rather than assist the passing of the bands 20 over the upper sets of jaws 64. To overcome this difficulty, a stationary bar 90 which extends parallel to the transverse bars 88 is mounted above the bands 20 between the jaws (63, 64) and the links 49.

Figure 14:
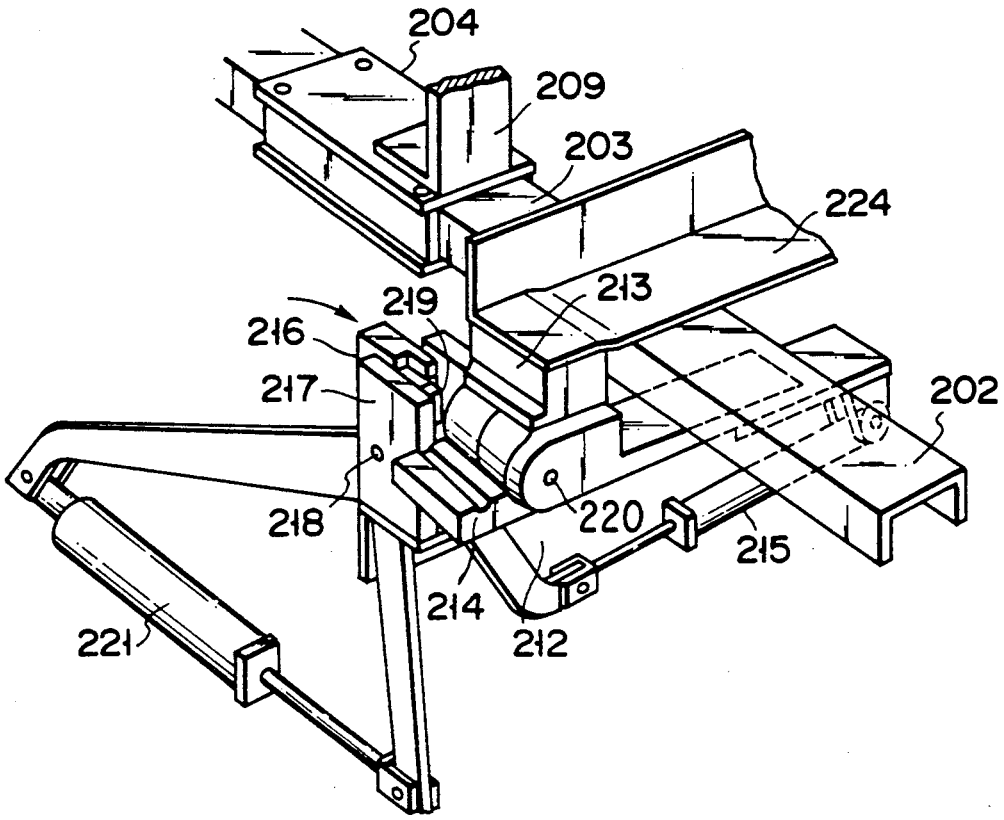
FIG. 14 is a perspective view showing a portion of the end treatment device shown in FIGS. 12 and 13.
Figure 15:
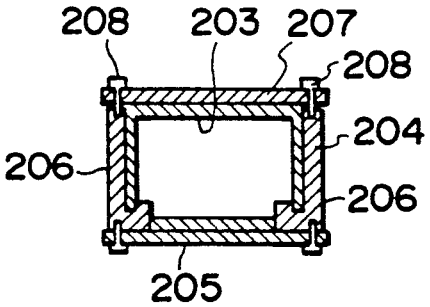
FIG. 15 is a sectional view showing a slider.

When the bands 20 are to be used for a semi-double or single-sized bed, the forward end of the helical wire 21 in the feeding direction cannot be cut off and bent by the forward-side tools 80 of the first end treatment device shown in FIG. 11. In such a case, the treatment is performed by a second end treatment device 201 disposed in the feeding direction of the spring bands 38, as shown in FIG. 4. Second end treatment device 201 has a support 202. Guide rail 203 is provided on support 202 such that guide rail 203 extends horizontally in the widthwise direction of the spring bands 38, as shown in FIGS. 12 to 15. Slider 204, as shown in FIG. 14, is slidably mounted on the guide rail 203. Slider 204, as shown in FIG. 15, comprises a bottom plate 205, opposite side plates 206, and a top plate 207. These plates 205–207 completely surround the outer periphery of the guide rail 203. When screws 208 securing top plate 207 to side plates 206 are loosened, the slider 204 can be moved along the guide rail 203.

Figure 12:
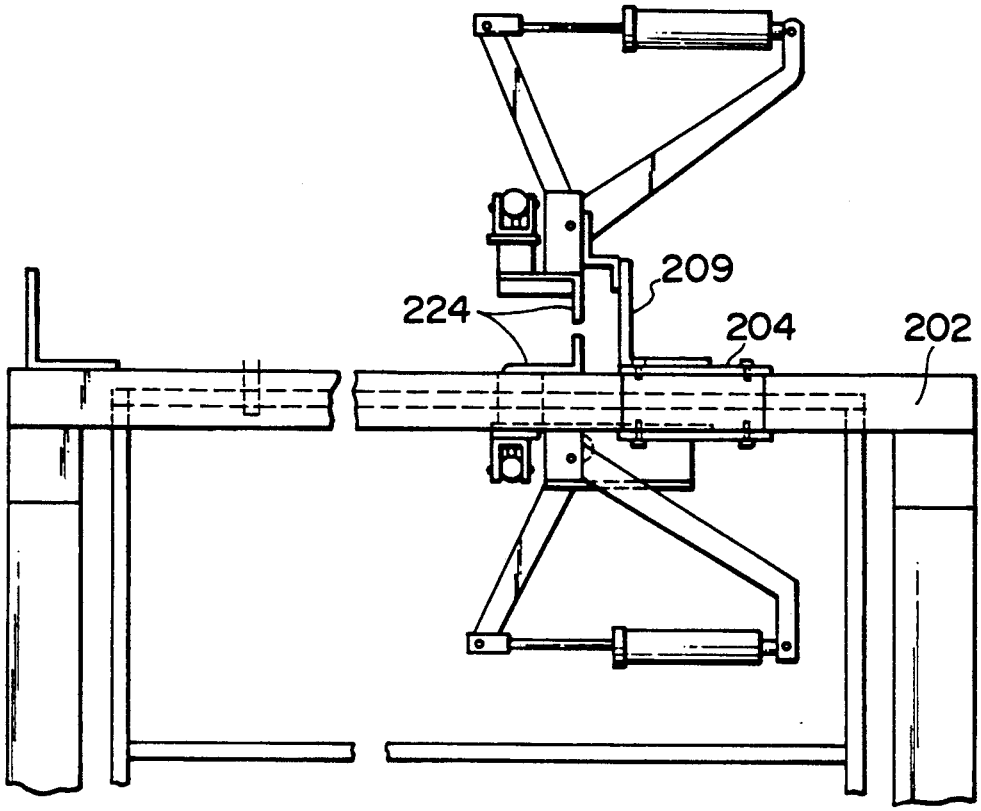
FIG. 12 is an elevational view showing an end treatment device shown in FIG. 4.
Figure 13:
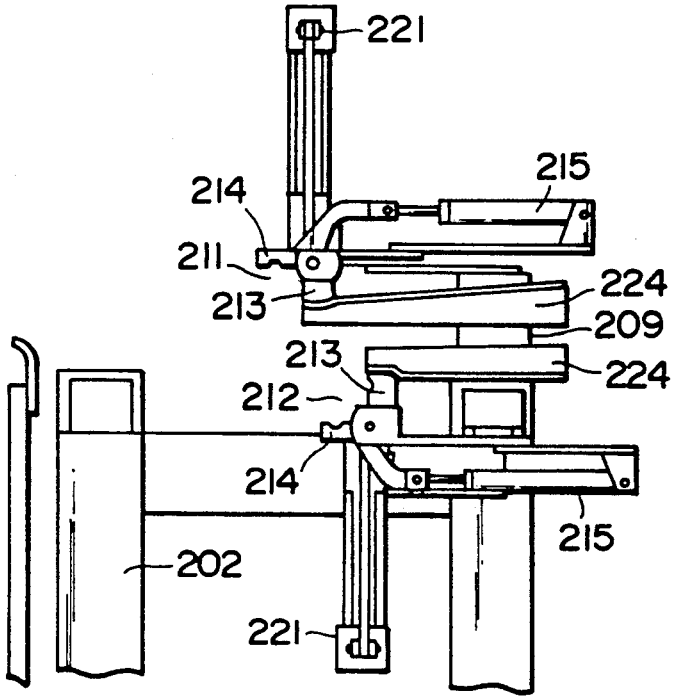
FIG. 13 is a side view showing the end treatment device shown in FIG. 12.

As shown in FIG. 13, there are upper and lower sets of jaws 211 and 212. As shown in FIG. 12, they are arranged on the slider 204 via mounting member 209. Jaws 211 and 212 of FIGS. 13 and 14 have the same structure as jaws 63 and 64 of FIGS. 4–11 provided in the main part of the apparatus. More specifically, as shown in FIG. 14, jaw 213 is fixed, while jaw 214 is pivotable about pin 220. Jaw 214 can be driven by a first piston-and-cylinder assembly 215.

Further, mounting member 209 is provided with a pair of upper and lower movable tools 216 having the same structure as the fixed tools 80 shown in FIG. 8. Each movable tool 216 is pivoted by pin 218 to movable member 217, to which cutter block 219 is secured. Further, each movable tool 216 of the pair is moved in the direction of an arrow shown in FIG. 14 by a second piston-and-cylinder assembly 221 (FIG. 13). When movable tools 216 are driven as shown in FIG. 14, like the case of FIG. 8, the helical wire 84 is urged against the cutter block 219 and its end is cut off. Then the cut end is bent toward the adjacent band until the cut end forms a closed or substantially closed loop.

When the size of the spring bands 38 is changed from that for the double size to that for the semi-double size or the single-sized bed, the slider 204 is moved in FIGS. 12 and 14 in accordance with the change in the width of the bands 38 to a position at which the movable tools 216, shown only in FIG. 14, face the forward edge face of the spring bands 38 in the widthwise direction thereof. The end of the helical wire 84 thus is cutoff and bent at the forward end face of the spring bands 38 in the widthwise direction thereof.

In this operation shown in FIG. 13, the first piston-and-cylinder assembly 215 is operated to close upper and lower jaws 211 and 212 and then helical wire 84 is held by the jaws 211 and 212. Next, the second piston-and-cylinder assembly 221 is operated to drive movable tools 216 (FIG. 14 only) and then the end of the helical wire 84 is cut off and bent. Thereafter, the first piston-and-cylinder assembly 215 is operated to open the upper and lower jaws 211 and 212 so as to release the helical wire 84. As a result, the third piston-and-cylinder assembly 221 shown in FIG. 13 and provided on support 202 is operated to rotate feed rod 222 (FIG. 4) about the lower end thereof in the direction of the arrow in FIG. 4. Consequently, feed pawl 223 provided on the upper end of the feed rod 222 engages the spring bands 38 and feeds them to the next stage. Second end treatment device 201 is synchronized to the first end treatment device as noted above. In FIGS. 12 to 14, guide members 224 are vertically spaced apart by a distance slightly greater than the thickness of the spring bands 38. These guide members 224 guide the forward end face of the spring bands 38 in the widthwise direction thereof.

The various processes described above can be started intermittently by the operator of the apparatus, and the operator can check the results of previous operations prior to the start of the next process. Alternatively, it is possible to permit some or all of the processes described above to be started automatically at the end of a previous process.

The feeding means noted above comprises the fingers 58 (FIGS. 7, 9*a*, 9*b*, and 9*c*) and the pawls 60 (FIG. 11) set to engage the bands 20. If it is found that the apparatus can be operated satisfactorily by omitting some of these parts, the feeding means may be formed by omitting such parts.

Figure 16:
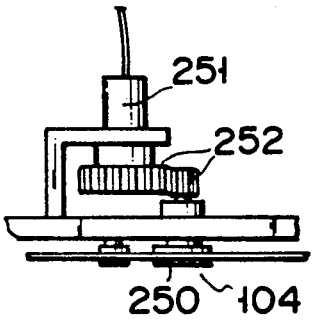
FIG. 16 is a top plan view showing a bend removal section.
Figure 17:
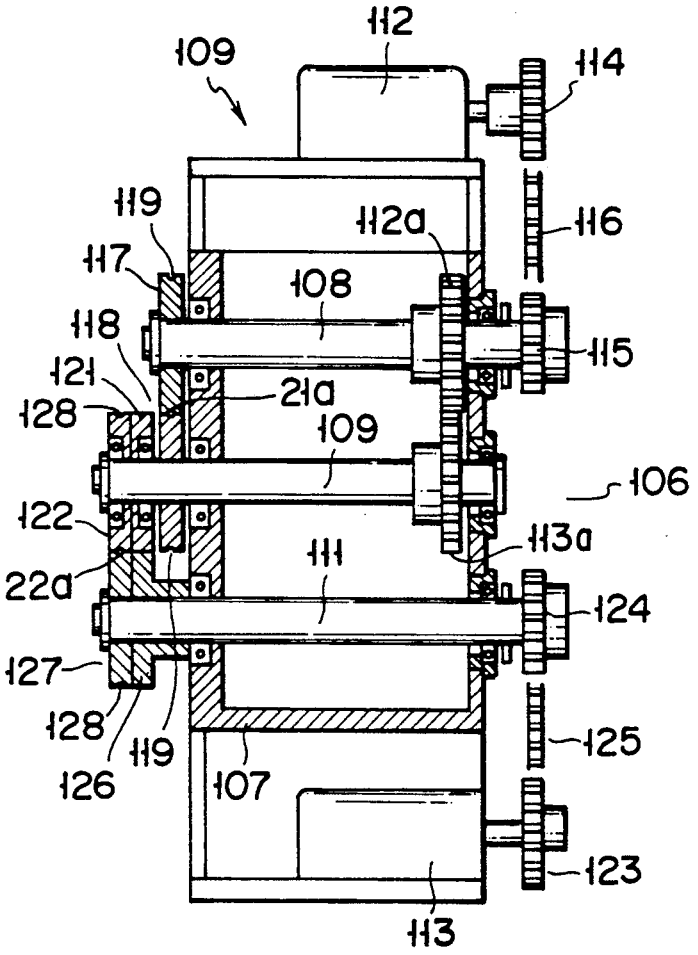
FIG. 17 is a sectional view showing a feeding mechanism.

Straight wires 21*a* and 22*a* are reformed by the reforming device 101 (FIG. 11) and are fed between the rollers 72 and 73 shown in FIG. 6. As shown in FIG. 11, the reforming device 101 comprises feeding mechanism 102 and forming mechanism 103. Feeding mechanism 102 includes a pair of bend removal sections 104 having a pair of upper and lower roller groups disposed for removing bends of the straight wires 21*a* and 22*a*, a pair of strain removal sections 105 for removing strain from the straight wires 21*a* and 22*a*, and a drive section 106 for feeding the straight wires 21*a* and 22*a* to the forming mechanism 103. As shown in FIG. 16, encoder 251 is coupled via gear train 252 to one roller 250 in the roller groups of the bend removal section 104 and converts the rotation numbers of roller 250 into an electric signal. The electric signal is supplied to a counter (not shown) in which the number of rotations is counted. The amount of feed of the straight wires 21*a* and 22*a* is calculated by the rotation number of the roller 250. Therefore, once a count of the counter is preset, the feeding of the straight wires 21*a* and 22*a* is stopped when a predetermined length of the straight wires 21*a* and 22*a* has been fed. In this way, the helical wires 21 and 22 can be fed in length corresponding to the length of the spring unit. The length depends on whether the spring unit is for single-sized, semi-double size or double-sized beds. It is to be understood that encoder 251 and roller 250 constitute feeding means for measuring and controlling the length of the straight wires 21*a* and 22*a* to be supplied. Drive section 106 (FIG. 11) includes a housing 107 as shown in FIG. 17. First shaft 108, second shaft 109, and third shaft 111 are rotatably mounted one above another in the mentioned order between parallel and spaced-apart side plates of the housing 107. Housing 107 is provided with a first motor 112 disposed in an upper portion and a second motor 113 disposed in a lower portion. First sprocket 114 is fitted on the output shaft of the first motor 112, and a first chain 116 is passed around the first sprocket 114 and a second sprocket 115 fitted on one end of the first shaft 108. First gear 112*a* is fitted on one end of the first shaft 108 and is meshed with a second gear 113*a* fitted on one end of the second shaft 109. First and second feed rollers 117 and 118 in rolling contact with each other are fitted on the other ends of respective first and second shafts 108 and 109. The outer peripheries of the feed rollers 117 and 118 have grooves 119, into which the straight wire 21*a* is introduced. Therefore, when the first motor 112 is operated, the first and second shafts 108 and 109 are rotated in opposite directions to feed the straight wire 21*a* clamped between the pair of feed rollers 117 and 118.

Third gear 121 and third feed roller 122 are rotatably mounted on the other end of the second shaft 109. Gear 121 and feed roller 122 are integrally coupled together. Third sprocket 123 is fitted on the output shaft of the second motor 113. Second chain 125 is passed around the third sprocket 123 and a fourth sprocket 124 fitted on one end of the third shaft 111. Fourth gear 126 meshing with the third gear 121 and a fourth feed roller 127 in rolling contact with the third feed roller 122 are fitted on the other end of the third shaft 111. Third feed roller 122 and fourth roller 127 have grooves 128 formed in their outer peripheries. The other straight wire 22*a* can be introduced into the grooves 128. Therefore, when the third shaft 111 is driven by the second motor 113, third and fourth rollers 122 and 127 are rotated in opposite directions by the meshing of the third and fourth gears 121 and 126, irrespective of the rotational state of the second shaft 109. Thus, the other straight wire 22*a* introduced between the feed rollers 122 and 127 is fed in the same direction as the straight wire 21*a*.

Figure 18:
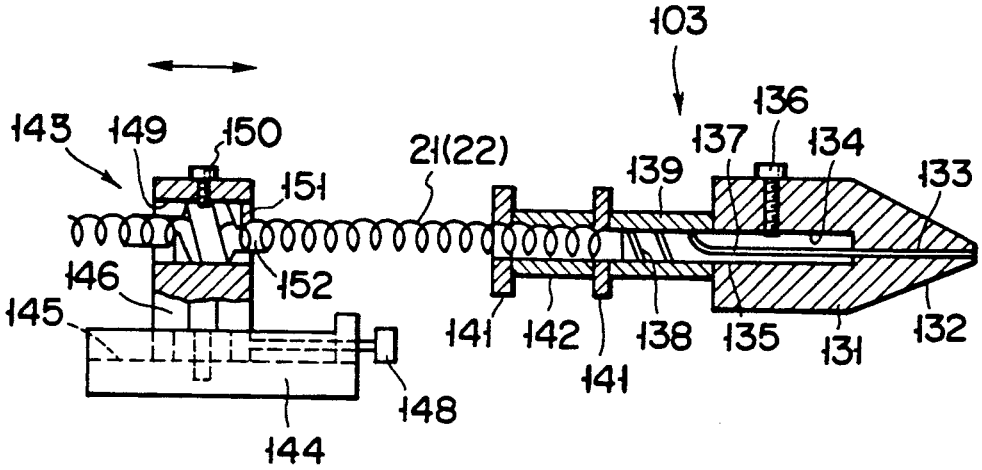
FIG. 18 is a sectional view showing a forming mechanism and an adjustment mechanism.

The pair of straight wires 21*a* and 22*a* fed by the feeding mechanism 102, which has the structure as described above in regard to FIG. 11, is each fed to the forming mechanism 103. Forming mechanism 103, as shown in FIG. 18, has guides 131. Each guide 131 has a tapered end 132. Tapered ends 132 are disposed such that they face outlets of the feeding mechanism 102 from which the pair of straight wires 21*a* and 22*a* are fed out. Each guide 131 has coaxial small and large diameter bores 133 and 134 extending axially and communicating with each other. Small bore hole 133 has an inner diameter slightly greater than the diameter of the straight wires 21*a* and 22*a*. Forming rod 135 is inserted into the large diameter bore 134 from one end thereof and is secured in position by a screw 136. Forming rod 135 has one end portion formed with a straight groove 137 communicating with the small bore hole 133 or the guide 131 and the other end portion formed with a helical groove 138 having one end communicating with the straight groove 137. Collar 139 is rotatably mounted on the other end portion of the rod 135 formed with the helical groove 138. Detachment of the collar 139 from the forming rod 135 is prevented by a guide cylinder 142 having opposite end flanges 141 and also having the same internal diameter as the forming rod 135. Guide cylinder 142 is secured to the reforming device 101. Thus, the straight wires 21*a* and 22*a* fed to guide 131 of the forming mechanism 103 are formed into the helical wires 21 and 22 noted above as they pass through the helical groove 138 of the forming rod 135.

Figure 19:
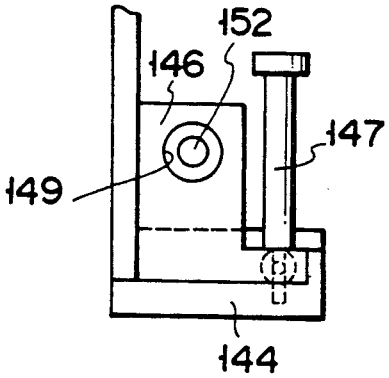
FIG. 19 is a side view showing the adjustment mechanism and an adjuster.

Helical wires 21 and 22 are fed into an adjustment mechanism 143. Adjustment mechanism 143 has a base 144 which is securely provided on the reforming device 101 as shown in FIG. 18. Base 144 has a slide groove 145 extending in the feeding direction of the helical wires 21 and 22. In the slide groove 145, an adjuster 146 is slidable and capable of being secured in a given position by a set screw 147 as shown in FIG. 19. Further, the base 144 is provided with an adjustment screw 148 (FIG. 18) for adjusting the position of the adjuster 146. Adjuster 146 has a mounting hole 149 shown in both FIGS. 18 and 19. Pitch shaft 152, which has a helical groove 151 (FIG. 18) at the same pitch as the helical wires 21 and 22, is inserted in the mounting hole 149 and secured by a set screw 150.

Helical wires 21 and 22 are formed by the forming mechanism 103 and pass the helical groove 151 of the pitch shaft 152. Thus, by changing the position of the helical groove 151 in the direction of the arrow shown in FIG. 18 due to the displacement of the pitch shaft 152 in the direction of the same arrow, the pitch of the helical wires 21 and 22 is changed as the wires 21 and 22 pass through the helical groove 151. Helical wires 21 and 22 formed by the forming mechanism 103 have a pitch which is varied slightly depending on the material of the wire (21, 22) or other factors. The pitch is therefore adjusted by the pitch adjustment mechanism 143.

Helical wires 21 and 22 with the pitch thereof having been adjusted by the pitch adjustment mechanism 143 are passed through cylindrical guides 153 to be fed between the rollers 72 and 73 as shown in FIG. 6. Roller 72, as shown in FIG. 6, is rotated by an endless belt 155 (FIG. 11) driven by a motor 154 (FIG. 11). Helical wires 21 an 22 that have been supplied between the pair of the rollers 72 and 73 (FIG. 6) disposed one above another are fed to the side limbs 25 of the bands 20 (FIG. 11) a they are rotated with the roller 72 (FIG. 6). Thus, the helical wires 21 and 22 (FIGS. 1 and 2) link side limbs 25 (FIG. 3) of the bands 20 (FIG. 1).

First and second motors 112 and 113 shown in FIG. 17 are stopped by a signal from the counter connected to encoder 251 (FIG. 16). When the straight wires 21*a* and 22*a* (FIG. 11) are fed to an amount of a predetermined length in accordance with the width of the bands 20, first and second motors 112 and 113 are stopped so that the straight wires 21*a* and 22*a* will no longer be fed.

Thus, the apparatus for manufacturing a spring unit according to the invention is very useful for readily manufacturing mattresses having different sizes and can also improve productivity.

We claim:

1. An apparatus for manufacturing a spring unit, in which coil springs are formed by bending a resilient wire, said coil springs being arranged side by side in a row such that side limbs of each of the coil springs are adjacent to one another, said coil springs also forming a band of springs which band has a predetermined thickness, and further in which helical wires are wound around the side limbs of each of the coil springs by moving the helical wires in an axial direction while the helical wires are rotated in a manner of a screw in a direction transverse to the band of springs, whereby the helical wires interconnect the side limbs of each of the coil springs in a jaw set attached in line to the apparatus, characterized in that the apparatus comprises:

means for feeding the helical wires while controlling a feeding length of the helical wires so as to be substantially equal to a width of the band of springs, and two alternate end treatment means, one of which is provided such that its position is adjustable in a widthwise direction of the band of springs, for cutting off and bending forward ends of the helical wires in a feeding direction thereof at a position where one end face of the band of springs is located, said one end treatment means being movable along the widthwise direction of the band of springs without detachment and movement of the jaw set.

* * * * *

UNITED STATES PATENT AND TRADEMARK OFFICE

CERTIFICATE OF CORRECTION

PATENT NO. : 5,172,736

DATED : December 22, 1992

INVENTOR(S) : Sasaki, et. al.

It is certified that error appears in the above-indentified patent and that said Letters Patent is hereby corrected as shown below:

Title page, item [30], delete both lines in their entirety.
Column 1, line 12, change "ar" to --are--.
Column 4, line 58, change "grove" to --groove--; and
line 64, change "are" to --is--.

Column 5, line 10, change "ar" to --are--;
line 15, change "59" to --50--;
line 29, after "of", insert --the--; and
line 40, change "a" to --at--.

Column 6, line 14, after "by", insert --an--; and
line 57, change "rear-most" to --rearmost--.

Column 11, line 44, change "an" to --and--.

Column 12, line 2, change "a" to --as--.

Signed and Sealed this

Twenty-sixth Day of April, 1994

Bruce Lehman

*Attest:*

BRUCE LEHMAN

*Attesting Officer*

*Commissioner of Patents and Trademarks*